United States Patent [19]

Gentry

[11] Patent Number: 4,723,915

[45] Date of Patent: Feb. 9, 1988

[54] TERMINAL ASSEMBLY HAVING CONDUCTOR STUFFER

[75] Inventor: John M. Gentry, Candler, N.C.

[73] Assignee: Brand-Rex Company, Willimantic, Conn.

[21] Appl. No.: 37,066

[22] Filed: Apr. 10, 1987

Related U.S. Application Data

[63] Continuation of Ser. No. 750,902, Jul. 1, 1985, abandoned.

[51] Int. Cl.[4] ..... H01R 4/24

[52] U.S. Cl. ..... 439/417

[58] Field of Search ..... 439/391, 393, 395, 396, 439/417

[56] References Cited

U.S. PATENT DOCUMENTS

| | | | |
|---|---|---|---|
| 3,895,852 | 7/1975 | Wasserlein, Jr. | 339/99 R |
| 3,910,672 | 10/1975 | Frantz | 439/417 |
| 4,040,705 | 8/1977 | Huber | 339/99 R |
| 4,405,193 | 9/1983 | Weidler | 339/99 R |
| 4,460,229 | 7/1984 | Matthews | 339/99 R |
| 4,508,411 | 4/1985 | Hughes et al. | 339/99 R |
| 4,536,050 | 8/1985 | Hung | 339/99 R |

*Primary Examiner*—Joseph H. McGlynn

*Attorney, Agent, or Firm*—McCormick, Paulding & Huber

[57] ABSTRACT

A wall outlet jack has a housing defining a row of terminal compartments each containing a bifurcated insulation displacement electrical terminal having a conductor receiving slot. A conductor stuffer releasably secured to the housing includes a plurality of stuffing members equal in number of the compartments. Each stuffing member has first and second parts which receive a terminal therebetween and a third part which extends through the conductor receiving slot in an associated terminal and connects the first and second parts. The third part controls stuffing depth and strengthens the conductor stuffer. The conductor stuffer also cooperates with the housing to provide a conductor strain relief device.

11 Claims, 15 Drawing Figures

TERMINAL ASSEMBLY HAVING CONDUCTOR STUFFER

This is a continuation of co-pending application Ser. No. 750,902 filed on July 1, 1985, now abandoned.

BACKGROUND OF THE INVENTION

This invention relates in general to electrical terminal assemblies and deals more particularly with an improved terminal assembly of the type which includes a bifurcated terminal having a conductor receiving slot and a conductor stuffer for forcing an electrical conductor into the slot and retaining it therein to provide permanent tight connection between the conductor and the terminal.

Terminal assemblies of the aforedescribed type have been heretofore provided. However, the conductor stuffers associated with such terminal assemblies usually engage spaced apart portions of a conductor at opposite sides of a slotted terminal in which the conductor is received and do not come into contact in the portion of the conductor which enters the terminal slot. More specifically, such a conductor stuffer applies pushing force to spaced apart portions of the conductor at opposite sides of a terminal to pull the portion of the conductor located therebetween into the terminal slot. The greatest resistance to seating the conductor in the terminal slot is encountered within the slot itself. Consequently, the portion of the conductor being pulled into the slot tends to bend or buckle. The aforedescribed conductor stuffer arrangement is not entirely satisfactory because it does not control stuffing depth of the buckled portion which may result in imperfect termination. Accordingly, it is the general aim of the present invention to provide a terminal assembly which includes an improved conductor stuffer for overcoming the aforedescribed problem. It is a further aim of the invention to provide an improved conductor stuffer which also functions as a strain relief device.

SUMMARY OF THE INVENTION

In accordance with the present invention an electrical terminal assembly comprises a bifurcated terminal which includes a pair of spaced apart upwardly projecting fingers having opposing inner surfaces which define an upwardly open conductor receiving slot. The assembly further includes a conductor stuffer which has depending spaced apart first and second parts receiving said terminal therebetween and a third part connecting said first and second parts and extending through the conductor receiving slot. The first second and third parts have downwardly facing conductor engaging surfaces thereon for engaging associated generally contiguous surface portions of a conductor to force the conductor into the conductor receiving slot when the conductor stuffer is moved to its assembled position relative to the terminal. The third portion controls conductor stuffing depth and provides a strengthening web connection between the first and second parts.

BRIEF DESCRIPTON OF THE DRAWINGS

DETAILED DESCRIPTION OF PREFERRED EMBODIMENT

Figure 1:
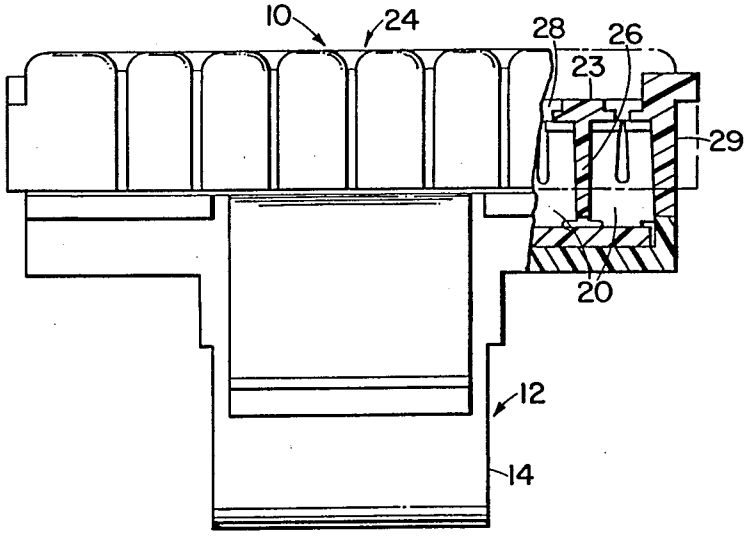
FIG. 1 is a fragmentary plan view of a wall outlet jack having a terminal assembly embodying the invention and shown with portions of its conductor stuffer and jack housing broken away.
Figure 2:
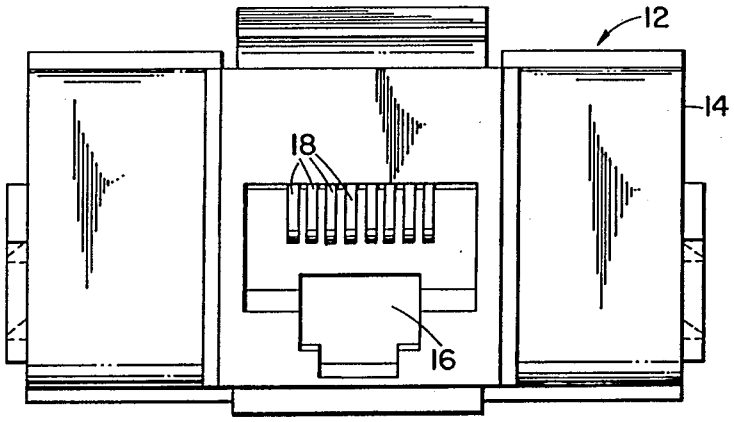
FIG. 2 is a front view of the wall outlet jack of FIG. 1.

Turning now to the drawings and referring first particulary to FIGS. 1–4 a terminal assembly embodying the present invention and indicated generally by the reference numeral 10 is hereinafter illustrated and described with reference to a wall outlet jack designated generally by the numeral 12. The illustrated wall outlet jack 12 is of a type widely used in the telecommunications field and has a terminal assembly to facilitate field termination of as many four pair of electrical conductors. The jack 12 has a housing indicated generally at 14 and defines a plug receiving cavity 16 which opens through the front end of the housing. A row of resilient spring wire contacts 18, 18 are supported within the housing 14 for establishing electrical contact with associated fixed contacts on a mating modular plug (not shown).

Figure 4:
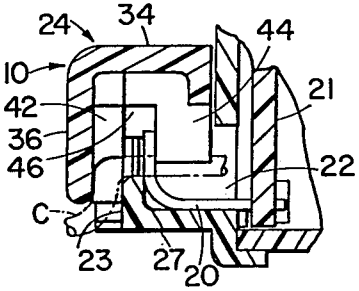
FIG. 4 is a fragmentary sectional view taken along the line 4—4 of FIG. 3

The terminal assembly which embodies the invention includes an array of bifurcated terminals 20, 20 equal in number to the spring wire contacts 18, 18. The terminals 20, 20 which may be of an insulation displacement type are supported by the housing and may be electrically connected to the spring contacts 16, 16 by any appropriate means. However, in the illustrated embodiment of the invention a printed circuit board 21 is employed for this purpose, as shown in FIG. 4, and is connected in a manner well in known in the electrical connector art.

Considering now the terminal assembly 10 in further detail, a rear portion of the housing 14 has a vertically disposed and transversely extending back wall 23 which includes an upper edge 25. The rear portion of the housing further includes a bottom wall 27 and end walls 29, 29. Side walls 26, 26 cooperate with the back wall 23, bottom wall 27 and side walls 29 29 to define a row of upwardly open terminal compartments 22, 22. Each terminal compartment 22 has an associated terminal 20 mounted within it. The terminal assembly 10 further includes a conductor stuffer designated generally by the numeral 24 which cooperates with the housing 14 and the terminals 20, 20 contained therein to terminate various conductors, such as the conductor C shown in FIG. 4, in a manner hereinafter more fully discussed.

Figure 3:
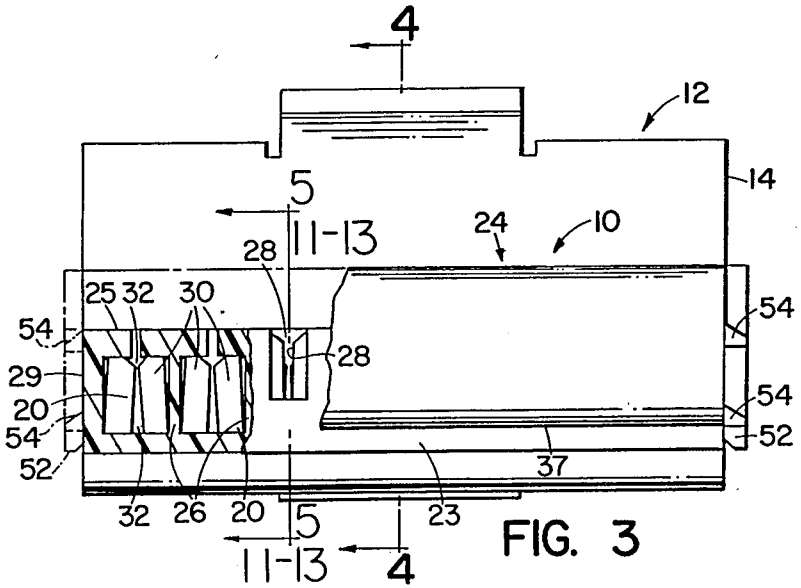
FIG. 3 is a fragmentary rear view of the wall outlet jack shown with portions of the conductor stuffer and jack housing broken away.

As previously noted, the illustrated structure is adapted to terminate as many as four pair of conductors and has eight terminals 20, 20, each terminal being housed within an associated individual compartment 22. Vertically disposed wall slots 28, 28 formed in the back wall 23 open through the upper edge 25, substantially as shown in FIG. 3.

The terminals used in practicing the invention are preferably of the insulation displacement type. A typical terminal has a pair of spaced apart and upwardly extending fingers 30, 30 including opposing inner wall surfaces which define an upwardly open conductor receiving slot 32. Each terminal is mounted in fixed position within our associated compartment 22 with at least a portion of its conductor receiving slot 32 in general registry with the associated wall slot 28 in the back wall 23.

The arrangement for mounting the terminals may vary. However, the presently preferred terminals are generally L-shaped and have a mounting base portion connected to the circuit board 21 which is mounted within the housing 14 and forms a common front wall for the various terminal compartments 22, 22.

Figure 10:
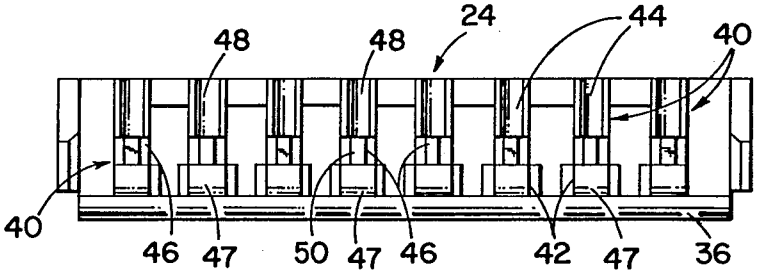
FIG. 10 is a bottom view of the conductor stuffer.
Figure 9:
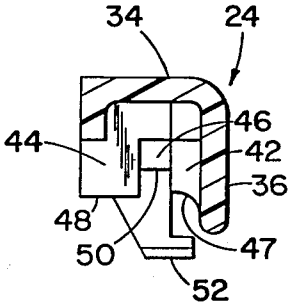
FIG. 9 is a sectional view taken along the line 9—9 of FIG. 7.
Figure 8:
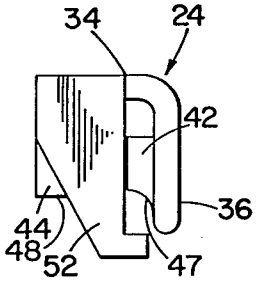
FIG. 8 is a right end elevational view of the conductor stuffer as it appears in FIG. 7.
Figure 13:
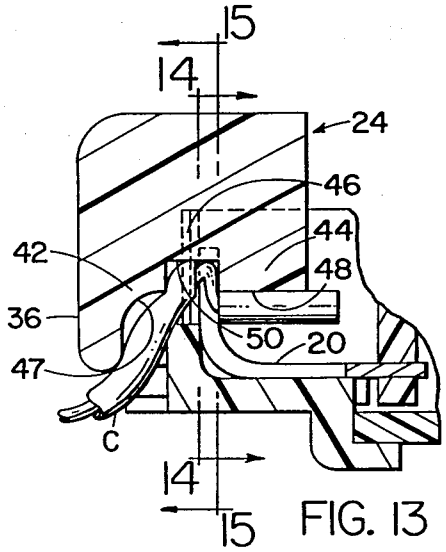
FIGS. 11–15 show the connector being assembled.
Figure 14:
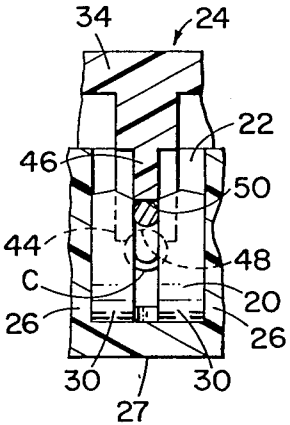
Figure 12:
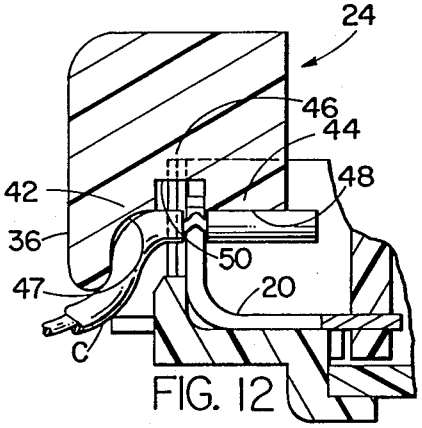
Figure 15:
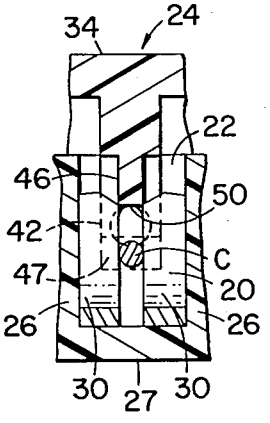
Figure 11:
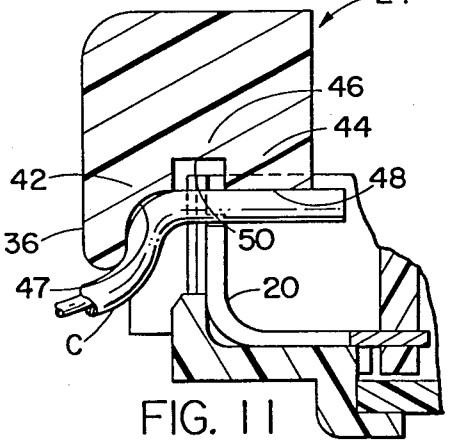

The conductor stuffer 24 is received on the rear portion of the housing 14 and forms a closure of the various terminal compartments 22, 22. It is preferably molded from dielectric plastic material and has a top wall 34 and a rear wall 36 which depends from the top wall 34 and terminates at a lower edge 37. A plurality of stuffing members indicated generally at 40, 40 and equal in number to the number of compartments 22, 22 are carried by the conductor stuffer 24 and are adapted to be received in the various compartments. A typical stuffing member 40, best shown in FIG. 10, includes a first part 42 mounted on the lower surface of the top wall 34 and the front surface of the rear wall and a second part 44 spaced forwardly of the first part and depending from the lower surface of the top wall 34. The second part 44 is spaced forwardly of the first part 42 at least a sufficient distance to allow a terminal 20 to be received therebetween. However, in the presently preferred construction each terminal 20 is mounted generally adjacent the front surface of the back wall 23. The second part 44 is spaced a sufficient distance from the first part 42 to allow both a terminal 20 and an associated portion of the back wall 23 to be received between the first and second parts.

Figure 7:
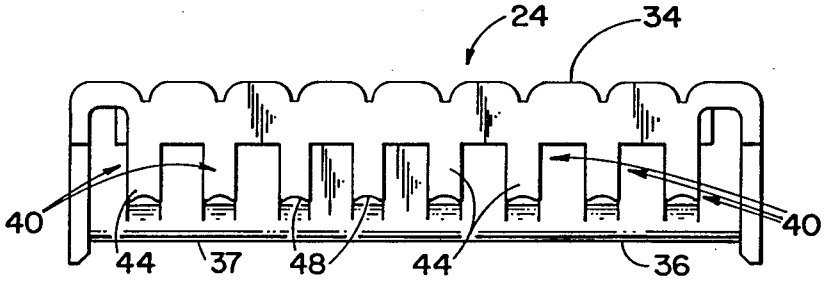
FIG. 7 is a front view of the conductor stuffer.
Figure 6:
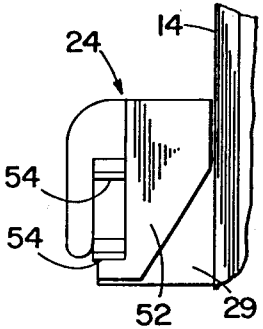
FIG. 6 is a fragmentary end view of the wall outlet jack.
Figure 5:
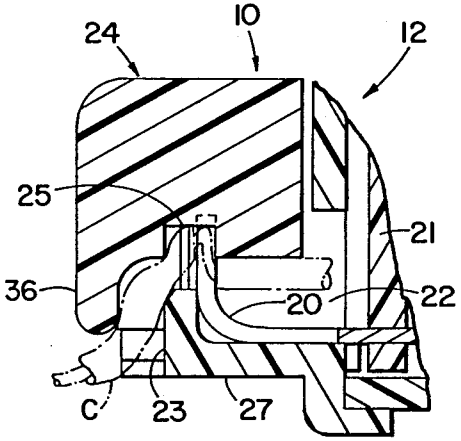
FIG. 5 is a somewhat fragmentary sectional view taken along the line 5—5 of FIG. 3.

In accordance with the present invention each stuffing member also has a third part 46 which is connected to and extends between the first and second parts 42 and 44 and is disposed within an associated terminal slot 32 and an associated front wall slot 28. The first, second and third parts have lower surfaces indicated at 47, 48 and 50, respectively. However, the lower surfaces 47 and 48 are disposed somewhat below the level of the lower surface 50 on of the third part. The lower surface of the second part 48 comprises a concave downwardly opening surface, best shown in FIG. 7, contoured to generally compliment a surface of an associated conductor C to be terminated.

Preferably, and as shown the first and second parts 42 and 44 are substantially wider than the terminal slot 32. The third part 46 is sized to be received within a terminal slot 32 and is connected to the top wall 34 and to the first and second parts 42 and 44. Its lower surface 50 is preferably spaced some distance above the lower surfaces 46 and 48, which lie generally within the common plane.

In assembly, the rear wall lower edge 37 is spaced some distance below the lower edges of the wall slots 28, 28.

Resilient latching members 52, 52 integrally connected to the top wall 34 depend from it and are arranged for snap engagement with fixed latching members 54, 54 on the housing end walls 29, 29. The latching tabs 52, 52 are preferably arranged for engagement with the fixed latching members 54, 54 in a plurality of positions.

The terminal assemblies may be employed to terminate bare wire conductors. However, the illustrated terminals of the present invention are particulary adapted for cutting through and displacing insulation on solid and stranded wire conductors to establish electrical connection with the conductors.

The end portion of a conductor C to be terminated is inserted downwardly into an associated slot 28 in back wall 23 and a slot 32 in an associated terminal 20. Thereupon, downward pull is exerted on the conductor C to effective initial engagement of the conductor with the terminal slot 32. This process is repeated for each conductor C to be terminated. Then the conductor stuffer 24 is assembled with the housing 14 with each stuffing member part 44 disposed within an associated terminal compartment 22. Thereafter, sufficient pressure is applied by and to the conductor stuffer 24 to seat it on the housing and at least initially engage each resilient latch tab 52 with associated latching member 54. The concave downwardly opening surface 48 on the second part straddles an associated portion of a conductor C and serves to align or center it with respect to an associated terminal slot 32. Initial assembly may be accomplished manually and without the aid of special tools. A pliers or other pincer tool having opposing jaws may then be used to seat the conductor stuffer 24 on the rear portion of the housing 14 with the resilient latching tabs 52, 52 engaged with appropriate latch members 54, 54 on the housing. Associated abutment surfaces on the housing 14 and the conductor stuffer 24 cooperate in coengagement to limit downward travel of the conductor stuffer to control stuffing depth. The overlapping arrangement of the rear wall 36 relative to the back wall 23 or more specifically the position of the lower edge 37 relative to the lower ends of the slots 28, 28 causes each conductor C to be deformed to the general shape shown in FIG. 4, whereby the conductor stuffer 24 serves as a strain relief device.

The terms top, bottom, front and rear have been used for convenience in describing the device, however, it should be understood that these terms are not intended to limit the device, since it may be used in any orientation.

I claim:

1. An electrical insulation displacement terminal assembly comprising a bifurcated insulation displacement terminal including a pair of laterally spaced apart upwardly projecting fingers having opposing inner surfaces defining an upwardly open conductor receiving slot, and a conductor stuffer having spaced apart first and second parts each having a lateral width greater than the width of said slot and receiving said terminal therebetween and a third part connected to and extending longitudinally between said first and second parts, said third part having a lateral width less than the lateral width of said conductor receiving slot and extending longitudinally through said conductor receiving slot, said first, second and third parts having downwardly facing conductor engaging surfaces thereof, for engaging contiguous portions of a conductor receiving within said conductor receiving slot and including the portion of the conductor within said conductor receiving slot said conductor engaging surfaces on said first and second parts being disposed below the conductor engaging surface on said third part.

2. An electrical terminal assembly as set forth in claim 1 wherein said conductor engaging surface on at least one of said parts comprising said first and second parts has a concave downwardly opening surface.

3. An electrical terminal assembly comprising means defining an upwardly opening compartment for containing a terminal and having opposing side walls and a back wall connected to and extending between said side walls, said back wall having a vertically disposed wall slot opening through its upper edge, a bifurcated electrical insulation displacement terminal having a pair of laterally spaced apart and vertically extending fingers defining an upwardly extending and upwardly opening conductor receiving slot therebetween, means for mounting said electrical insulation displacement terminal in fixed position within said compartment with said conductor receiving slot in general alignment with said wall slot, and a conductor stuffer and strain relief device assembled with said terminal compartment defining means and forming a closure for said upwardly opening compartment, said conductor stuffer and strain relief device having a top wall and a rear wall depending from said top wall, said rear wall being disposed outside of said compartment and spaced rearwardly of said back wall a distance substantially equal to the major cross sectional dimension of an insulated conductor received within said conductor receiving slot, said rear wall cooperating in opposing relation with said back wall to receive an axially downwardly extending portion of the insulated conductor therebetween, said conductor stuffer and strain relief device having a first part extending downwardly from said top wall and forwardly from said rear wall and including a frontal surface engaging the rear surface of said back wall and a lower surface for engaging an associated portion of the upper surface of a conductor received in said conductor receiving slot and disposed between said back wall and said rear wall, said conductor stuffer and strain relief device having a second part depending from said top wall and spaced forwardly of said first part, said second part extending into said terminal compartment generally forwardly adjacent the slot defining portions of said fingers, said second part having a lower surface for engaging an associated generally axialy horizontally extending portion of a conductor received in and extending axially through said conductor receiving slot said conductor stuffer having a third part depending from said top wall and extending between said first part and said second part, said third part having a lateral width less than the lateral width of said conductor receiving slot and extending through said wall slot and said conductor receiving slot and a having a downwardly facing lower surface for engaging within said conductor receiving slot an associated portion of the upper surface of a conductor received in said conductor receiving slot, said first, second and third parts exerting downwardly directed force upon associated contiguous portions of the conductor to force the conductor into said conductor receiving slot when said conductor stuffer and strain relief device is moved into assembly with said compartment defining means.

4. An electrical terminal assembly as set forth in claim 3 wherein said conductor engaging lower surfaces on said first and second parts are disposed below the conductor engaging lower surface on said third part.

5. An electrical conductor assembly as set forth in claim 3 wherein said rear wall has a lower edge disposed below the lower extremity of said conductor receiving slot.

6. An electrical conductor assembly as set forth in claim 5 wherein said lower edge is disposed below the lower extremity of said wall slot.

7. An electrical terminal assembly as set forth in claim 3 including means for releasably securing said conductor stuffer in at least one position of assembly with said compartment defining means.

8. An electrical terminal assembly as set forth in claim 7 wherein said releasably securing means comprises resilient latching tabs carried by said conductor stuffer for engaging mating latching elements on said compartment defining means.

9. An electrical terminal assembly comprising means defining a compartment for containing a terminal and having a back wall including a vertically disposed wall slot opening through its upper edge, a bifurcated electrical insulation displacement terminal having a pair of laterally spaced apart and vertically extenidng fingers defining an upwardly extending upwardly opening insulated displacing conductor receiving slot therebetween, means for mounting said electrical terminal in fixed position within said compartment with said conductor receiving slot in generall alignment with said wall slot, and a conductor stuffer and strain relief device assembled with said terminal compartment defining means and having a top wall and a rear wall depending from said top wall, said rear wall being disposed outside of said compartment and spaced rearwardly of said back wall a distance substantially equal to the outside diameter of an insulated conductor received within said conductor receiving slot, said rear wall cooperating with said back wall to receive an axially downwardly extending portion of the insulated conductor therebetween, said conductor stuffer and strain relief device having first part disposed externally of said compartment and extending downwardly from said top wall and forwardly from said rear wall and including a frontal surface engaging the rear surface of said back wall and a lower surface for engaging an associated portion of the upper surface of a conductor received in said conductor receiving slot, said conductor stuffer having a second part spaced forwardly of said first part and extending into said terminal compartment generally forwardly adjacent the slot defining portions of said fingers, said second part having a lwoer surface for engaging an associated portion of the upper surface of a conductor received within said conductor receiving slot, said conductor stuffer and strain relief device having a third part connected to and extending between said first part and said second part and being of lesser lateral width than said first and second parts, said third part extending through said wall slot and said conductor receiving slot and having a downwardly facing lower surface disposed above the lower surface of said first part and the lower surface of said second part for engaging within said conductor receiving slot an associated upper portion of the surface of a conductor received in said conductor receiving slot, and means for releasably retaining said conductor stuffer and strain relief device in assembly with said compartment defining means, said first, second and third parts exerting downwardly directed force upon associated contiguous portions of the conductor to force the conductor into said conductor receiving slot when said conductor stuffer and strain relief device is moved into assembly with said compartment defining means.

10. An electrical terminal assembly as set forth in claim 9 wherein said rear wall has a lower edge disposed below the lower extremity of said conductor receiving slot.

11. An electrical terminal assembly as set forth in claim 10 wherein said lower edge is disposed below the lower extremity of said wall slot.

* * * * *